US009980617B2

(12) United States Patent
Denhof

(10) Patent No.: US 9,980,617 B2
(45) Date of Patent: May 29, 2018

(54) VACUUM CLEANER

(71) Applicant: BISSELL Homecare, Inc., Grand Rapids, MI (US)

(72) Inventor: Julie Christine Denhof, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 316 days.

(21) Appl. No.: 14/748,330

(22) Filed: Jun. 24, 2015

(65) Prior Publication Data

US 2015/0374187 A1 Dec. 31, 2015

Related U.S. Application Data

(60) Provisional application No. 62/018,066, filed on Jun. 27, 2014.

(51) Int. Cl.

| | |
|---|---|
| ***A47L 9/16*** | (2006.01) |
| ***A47L 5/30*** | (2006.01) |
| ***A47L 9/04*** | (2006.01) |
| ***A47L 9/02*** | (2006.01) |

(52) U.S. Cl.

CPC ..... *A47L 5/30* (2013.01); *A47L 9/02* (2013.01); *A47L 9/0477* (2013.01)

(58) Field of Classification Search

CPC ..... A47L 5/30; A47L 9/02; A47L 9/0477

See application file for complete search history.

(56) References Cited

U.S. PATENT DOCUMENTS

| | | | | |
|---|---|---|---|---|
| 1,254,396 | A | 1/1918 | Dance | |
| 2,851,717 | A | 9/1958 | Kasper | |
| 3,286,296 | A | 11/1966 | Waters | |
| 3,733,640 | A * | 5/1973 | Finberg | A47L 9/02 15/402 |
| 4,802,254 | A | 2/1989 | Lahndorff et al. | |
| 6,799,351 | B2 | 10/2004 | Porath | |
| 8,418,313 | B1 * | 4/2013 | Miner | A47L 9/02 15/325 |
| 8,789,235 | B2 * | 7/2014 | Krebs | A47L 5/34 15/319 |
| 2002/0124346 | A1 * | 9/2002 | Steiner | A47L 9/04 15/384 |
| 2002/0129462 | A1 * | 9/2002 | Matusz | A47L 5/30 15/384 |
| 2012/0124769 | A1 * | 5/2012 | Krebs | A47L 5/34 15/319 |

* cited by examiner

*Primary Examiner* — Marc Carlson

(74) *Attorney, Agent, or Firm* — McGarry Bair PC

(57) ABSTRACT

A vacuum cleaner includes a suction nozzle, a source of suction in fluid communication with the suction nozzle for generating a working airstream through the suction nozzle, an agitator provided within the suction nozzle, and a sole plate provided on a lower side the suction nozzle, wherein the sole plate comprises a plurality of upwardly curved cross ribs.

18 Claims, 7 Drawing Sheets

VACUUM CLEANER

CROSS REFERENCE TO RELATED APPLICATION(S)

This application claims the benefit of U.S. Provisional Patent Application No. 62/018,066, filed Jun. 27, 2014, which is incorporated herein by reference in its entirety.

BACKGROUND

Vacuum cleaners can comprise an agitator for agitating debris on a surface to be cleaned so that the debris is more easily ingested into the vacuum cleaner. In some cases, the agitator comprises a motor-driven brushroll that rotates within a suction nozzle. The suction nozzle can comprise a sole plate fastened to the underside of the suction nozzle to secure the agitator and define a suction inlet.

FIG. 1 is a perspective view of a prior art sole plate 10 of a vacuum cleaner that comprises a perimeter frame portion 11 having a front wall 12 and rear wall 13 joined by two side walls. Linear cross ribs 14 extend between the front wall 12 and rear wall 13 of the perimeter frame portion 11 to provide stiffness to the frame portion 11. The space between the linear cross ribs 14 and the front and rear walls 12, 13 define suction nozzle openings 16.

FIG. 2 is cross sectional view of a portion of a prior art suction nozzle 20 of a vacuum cleaner including the sole plate 10 from FIG. 1. The suction nozzle 20 may, for example, be provided as a base for an upright-type vacuum cleaner or as a cleaning head for a canister-type vacuum cleaner. As illustrated, the sole plate 10 is fastened to the underside of the suction nozzle 20 to secure an agitator 22 disposed within the suction nozzle 20. The linear cross ribs 14 of the sole plate 10 are typically arranged such that they are substantially parallel to and in contact with a surface to be cleaned S as illustrated.

BRIEF SUMMARY

According to one embodiment of the invention, a vacuum cleaner includes a housing having a suction nozzle, a source of suction in fluid communication with the suction nozzle for generating a working airstream through the suction nozzle, a separating and collection assembly for separating and collecting debris from the working airstream, an agitator provided within the suction nozzle, and a sole plate defining a suction inlet for the suction nozzle and provided on a lower side of the suction nozzle, wherein the sole plate comprises a front wall, a rear wall, and a plurality of upwardly-curved cross ribs extending between the front and rear walls.

DETAILED DESCRIPTION

The invention relates to surface cleaning apparatus and in particular to vacuum cleaners having a sole plate. For purposes of description related to the figures, the terms "upper," "lower," "right," "left," "rear," "front," "vertical," "horizontal," and derivatives thereof shall relate from the perspective of a user in a typical operating position behind the vacuum cleaner, which defines the rear of the vacuum cleaner. However, it is to be understood that the invention may assume various alternative orientations, except where expressly specified to the contrary.

Figure 3:
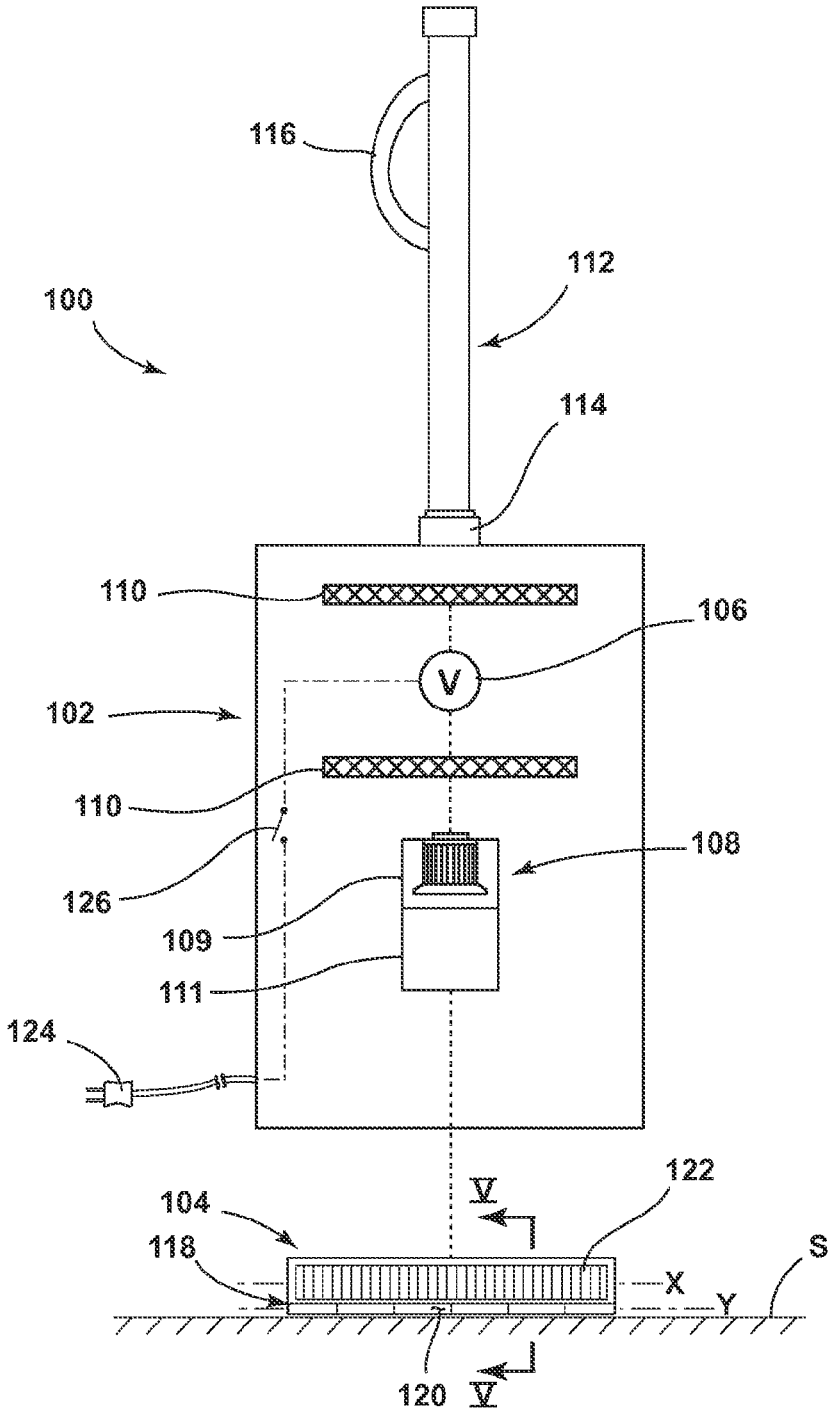
FIG. 3 is a schematic view of a vacuum cleaner according to an embodiment of the invention.

FIG. 3 is a schematic view of a vacuum cleaner 100 according to an embodiment of the invention. The vacuum cleaner 100 is shown herein as an upright-type vacuum cleaner, with a housing including an upright unit 102 coupled with a base unit 104 adapted to be moved over a surface to be cleaned S. The vacuum cleaner 100 can alternatively be configured as a canister-type vacuum cleaner, a stick vacuum cleaner, or a hand-held vacuum cleaner. Furthermore, the vacuum cleaner 100 can additionally be configured to distribute a fluid and/or to extract a fluid, where the fluid may for example be liquid or steam.

The upright unit 102 can comprise a vacuum collection system for creating a partial vacuum to remove debris (which may include dirt, dust, soil, hair, and other debris) from the surface to be cleaned S and collect the removed debris in a collector provided on the vacuum cleaner 100 for later disposal.

The upright unit 102 comprises a suction source 106 in fluid communication with the base unit 104 for generating a working airstream and a separating and collection assembly 108 for separating and collecting debris from the working airstream for later disposal. The upright unit 102 further comprises a handle 112 to facilitate movement of the vacuum cleaner 100 by a user. A handle coupler 114 can receive the proximal end of the handle 112, which may be fixed with respect to the upright unit 102. Alternatively, the handle coupler 114 may be configured to telescopically mount the proximal end of the handle 112 so that the handle 112 can be retracted or extended with respect to the upright unit 102. In yet another configuration, the handle coupler 114 may pivot such that the handle 112 can rotate or fold about a horizontal axis relative to the upright unit 102. A handle grip 116 may be provided on the distal end of the handle 112.

In one configuration illustrated herein, the collection assembly 108 can comprise a cyclone separator 109 for separating contaminants from a working airstream and a removable debris cup 111 for receiving and collecting the separated contaminants from the cyclone separator 109. The cyclone separator 109 can have a single cyclonic separation stage, or multiple stages. In another configuration, the collection assembly 108 can comprise an integrally formed cyclone separator 109 and debris cup 111, with the debris cup 111 being provided with a structure, such as a bottom-opening debris door, for debris disposal. It is understood that other types of collection assemblies 108 can be used, such as a centrifugal separator, a bulk separator, a filter bag, or a water-bath separator. The upright unit 102 can also be provided with one or more additional filters 110 upstream or downstream of the separating and collection assembly 108 or the suction source 106.

The suction source 106, such as a motor/fan assembly, is provided in fluid communication with the separating and collection assembly 108, and can be positioned downstream or upstream of the separating and collection assembly 108. The suction source 106 can be electrically coupled to a power source 124, such as a battery or by a power cord plugged into a household electrical outlet. A power switch 126 between the suction source 106 and the power source 124 can be selectively closed by the user upon pressing a power button (not shown), thereby activating the suction source 106. As shown herein, the suction source 106 is downstream of the separating and collection assembly 108 for a 'clean air' system; alternatively, the suction source 106 can be upstream of the separation and collection assembly 108 for a 'dirty air' system.

The base unit 104 is in fluid communication with the suction source 106 for engaging and cleaning the surface to be cleaned S. The base unit 104 can be coupled to the upright unit 102 by a single or multi-axis joint, such as a Cardan joint (not shown), so that the upright unit 102 can rotate about one or more axes relative to the base unit 104. The base unit 104 comprises an upper base housing 117 and a sole plate 118 fastened to the underside of the upper base housing 117. The sole plate 118 defines a suction inlet 120 in fluid communication with the separating and collection assembly 108. The sole plate 118 can secure an agitator 122 within the base unit 104 for agitating the surface to be cleaned so that the debris may be more easily ingested into the suction inlet 120. Some examples of agitators 122 include, but are not limited to, a rotatable brushroll, dual rotating brushrolls, or a stationary brush, such as a strip brush. The agitator 122 illustrated herein is a rotatable brushroll positioned within the base unit 104 adjacent the suction inlet 120 for rotational movement about an axis X, and can be coupled to and driven by a dedicated agitator motor provided in the base unit 104 via a commonly known arrangement including a drive belt. Alternatively, the agitator 122 can be coupled to and driven by the suction source 106 in the upright unit 102. It is within the scope of the invention for the agitator 122 to be mounted within the base unit 104 in a fixed or floating vertical position relative to the base unit 104 and sole plate 118.

The vacuum cleaner 100 can be used to effectively clean the surface to be cleaned S by removing debris from the surface to be cleaned S in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

To perform vacuum cleaning with the vacuum cleaner 100 configuration shown in FIG. 3, the suction source 106 is coupled to the power source 124 to generate a working airstream that draws in debris-laden air through the base unit 104 and into the separating and collection assembly 108 where the debris is substantially separated from the working air. The airstream then flows through the suction source 106, and through any optional filters 110 positioned upstream and/or downstream from the suction source 106, prior to being exhausted from the vacuum cleaner 100. During vacuum cleaning, the agitator 122 can agitate the surface to be cleaned S so that the debris is more easily ingested into the suction inlet 120. The separating and collection assembly 108 can be periodically emptied of debris. Likewise, the optional filters 110 can periodically be cleaned or replaced.

Figure 4:
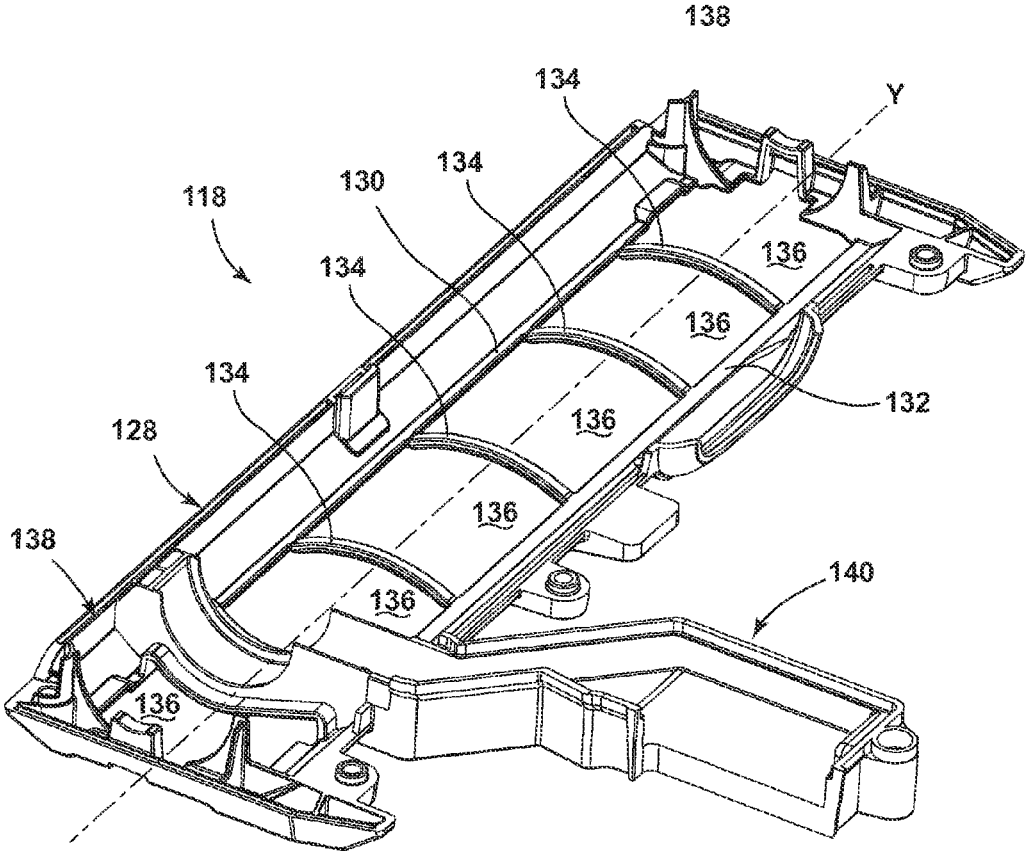
FIG. 4 is a perspective view of a sole plate for the vacuum cleaner of FIG. 3.

FIG. 4 is a perspective view of the sole plate 118 for the vacuum cleaner 100 of FIG. 3. The sole plate 118 comprises a perimeter frame portion 128 having a front wall 130 and rear wall 132 joined by two opposing side walls 133. Upwardly curved cross ribs 134 extend perpendicularly between the front wall 130 and rear wall 132 of the frame portion 128. The space between the upwardly curved cross ribs 134 and the front and rear walls 130, 132 define multiple suction nozzle openings 136, which collectively form the suction inlet 120.

The sole plate 118 may also comprise agitator mounting locations 138 disposed on the opposing side walls 133 of the frame portion 128, which are configured to mount the agitator 122 (FIG. 3) adjacent the suction inlet 120, such that the agitator 122 extends over the suction nozzle openings 136 and in register with the surface to be cleaned, S. The sole plate 118 may further comprise a belt guard 140 configured to protect a drive belt (not shown) for rotating the agitator 122. The spaces between the belt guard 140, the frame portion 128 and/or the upwardly curved cross ribs 134 may also define one or more suction nozzle openings 136.

Figure 5:
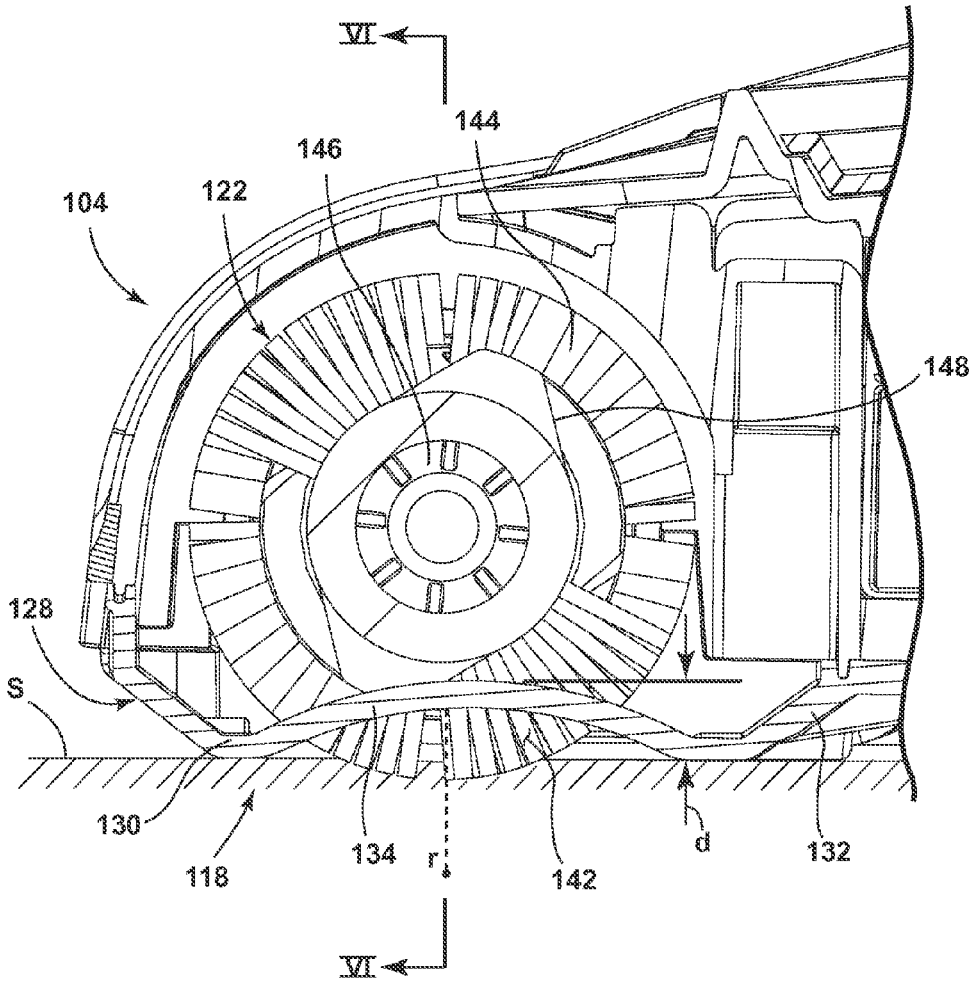
FIG. 5 is a cross sectional view taken along line V-V of FIG. 3 showing the base unit for the vacuum cleaner.

FIG. 5 is a cross-sectional view of the base unit 104 for the vacuum cleaner 100 of FIG. 3. The sole plate 118 is fastened to the underside of the upper base housing 117 such that at least a portion of the perimeter frame portion 128 is in contact with the surface to be cleaned S and the upwardly curved cross ribs 134 are not in contact with the surface to be cleaned S. For example, as illustrated at least the front and rear walls 130, 132 of the frame portion 128 are in contact with the surface to be cleaned S. The upwardly curved cross ribs 134 each have a radius of curvature r such that a substantially semicircular gap 142 is formed between the surface to be cleaned S and the bottom surface of the upwardly curved cross ribs 134. The size of the gap 142 can vary depending on the radius of curvature r. In an exemplary embodiment, the radius of curvature r forms semicircular gaps 142 that define a maximum vertical distance, d, between the surface to be cleaned, S, and the bottom surface of the upper most portions of the upwardly curved cross ribs 134. In an exemplary embodiment, the maximum vertical distance, d, is in the range of 0.25" to 0.75".

Figure 7:
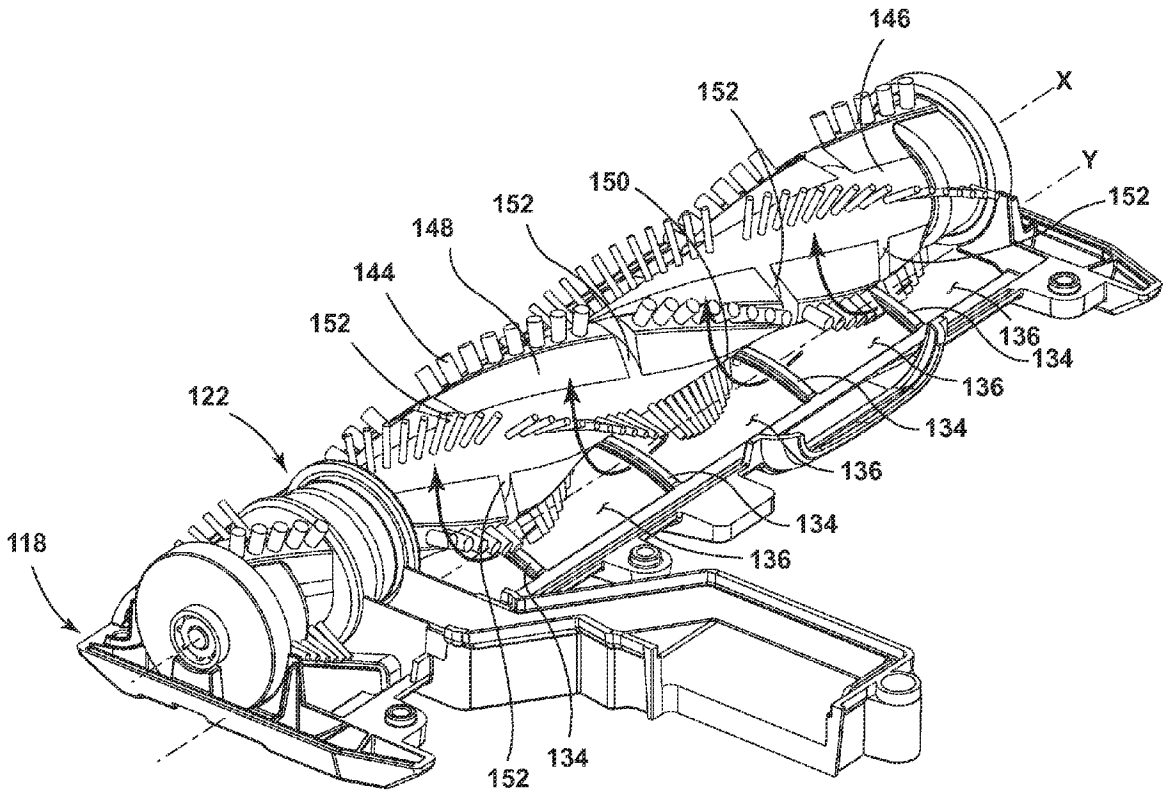
FIG. 7 is a perspective view of a sole plate and agitator for the vacuum cleaner of FIG. 3.

The semicircular gaps 142 can collectively define a tunnel forming a debris path axis Y shown in FIGS. 3-4 and 7 such that debris may pass beneath the upwardly curved cross ribs 134 through the semicircular gaps 142 in a substantially lateral direction along the debris path axis Y before being ingested through the suction nozzle openings 136. It will be understood the upwardly curved cross ribs 134 may have any radius of curvature r to achieve desired dimensions of the semicircular gap 142. However, substituting one or more upwardly curved cross ribs 134 with a cross rib having an alternate shape that still forms a gap between the surface to be cleaned, S, and the bottom surface of the cross rib is contemplated. For example, one or more upwardly curved cross ribs 134 can be replaced by an alternate cross rib having a linear, wavy, stepped or triangular shape, provided that the alternate cross rib does not substantially interrupt or block the debris path.

The agitator 122 is secured by the sole plate 118 such that it is disposed substantially above the sole plate 118. The agitator 122 may comprise a plurality of bristles 144 projecting from a dowel 146. The dowel 146 may include protrusions 148 forming a helical pattern circumferentially along the length the dowel 146 as best seen in FIG. 7. The proximal end of the bristles 144 may protrude in a substantially helical pattern wrapping around the dowel 146 along the length of the dowel 146. The distal end of the bristles 144 extend to or into the surface to be cleaned S through the suction nozzle openings 136, past the upwardly curved cross ribs 134.

Figure 6:
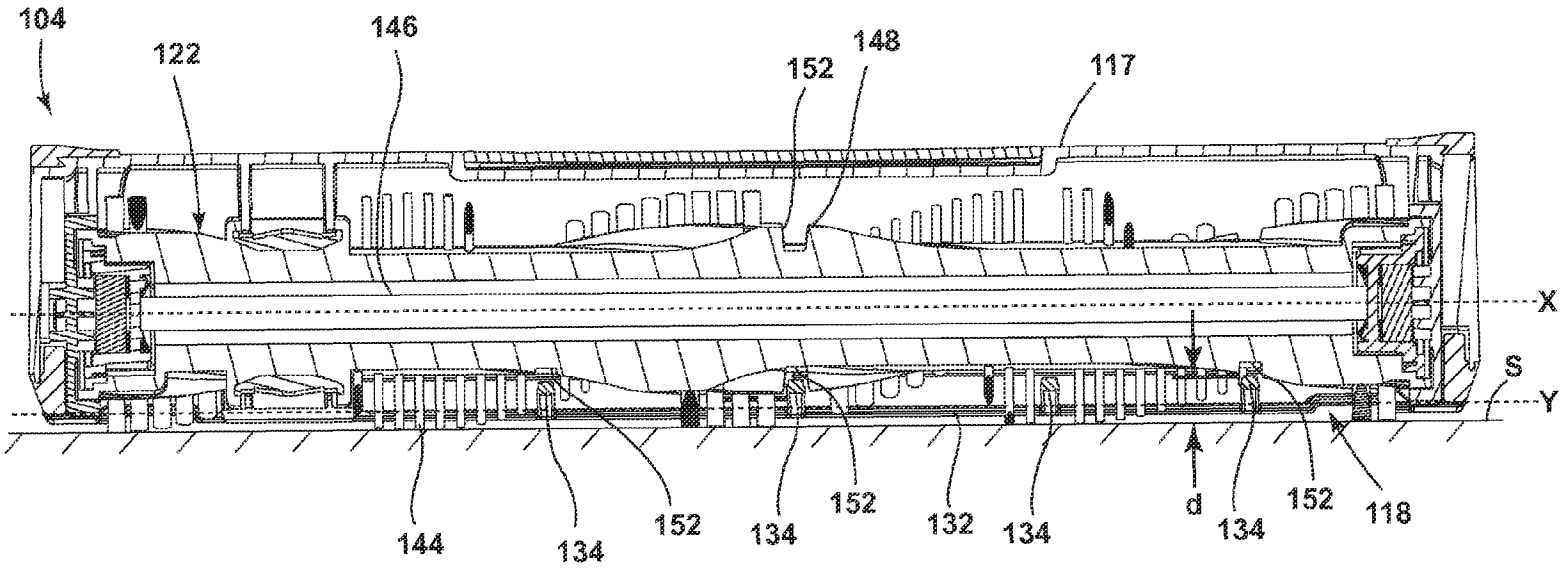
FIG. 6 is a cross sectional view taken along line VI-VI of FIG. 5 showing the base unit for the vacuum cleaner 3.

As seen in FIG. 6, a plurality of grooves 152 can be formed on the dowel 146. The grooves 152 can wrap around the circumference of the dowel 146 and can be arranged and sized to form a recess for receiving the upwardly curved cross ribs 134. The width of the grooves 152 is sufficient to clear the width of the upwardly curved cross ribs 134 and no bristles 144 are tufted in the grooves 152 so that the upwardly curved cross ribs 134 do not contact any portion of the agitator 122 as it rotates. The depth of the grooves 152 can be adjusted to accommodate upwardly curved cross ribs 134 having different radius of curvature r and maximum vertical distance, d dimensions.

In operation, with reference to FIGS. 3-7, the vacuum cleaner 100 is energized and the suction source 106 generates a working airstream that draws in debris-laden air through the suction inlet 120 into the base unit 104. The agitator 122 is in register with the surface to be cleaned S and rotates about the X axis. The rotating bristles 144 agitate the surface to be cleaned, S, and move debris located on or within the surface, S, into the working airstream whereupon the debris is separated and collected in a downstream separating and collection assembly 108. The helical pattern of the bristles 144 may create an auguring effect, moving the debris along the debris path axis Y in a direction based on the direction of rotation of the agitator 122 and the arrangement of the helical pattern of the bristles 144. The semicircular gaps 142 created by the upwardly curved cross ribs 134 on the sole plate 118 allow the debris being augured along the debris path axis Y to pass under the upwardly curved cross ribs 134 in a substantially lateral direction, thus preventing debris from becoming trapped or blocked by the upwardly curved cross ribs 134 so that the debris may be drawn through the suction nozzle openings 136 and into the base unit 104 as indicated by arrows 150 (FIG. 7).

Figure 1:
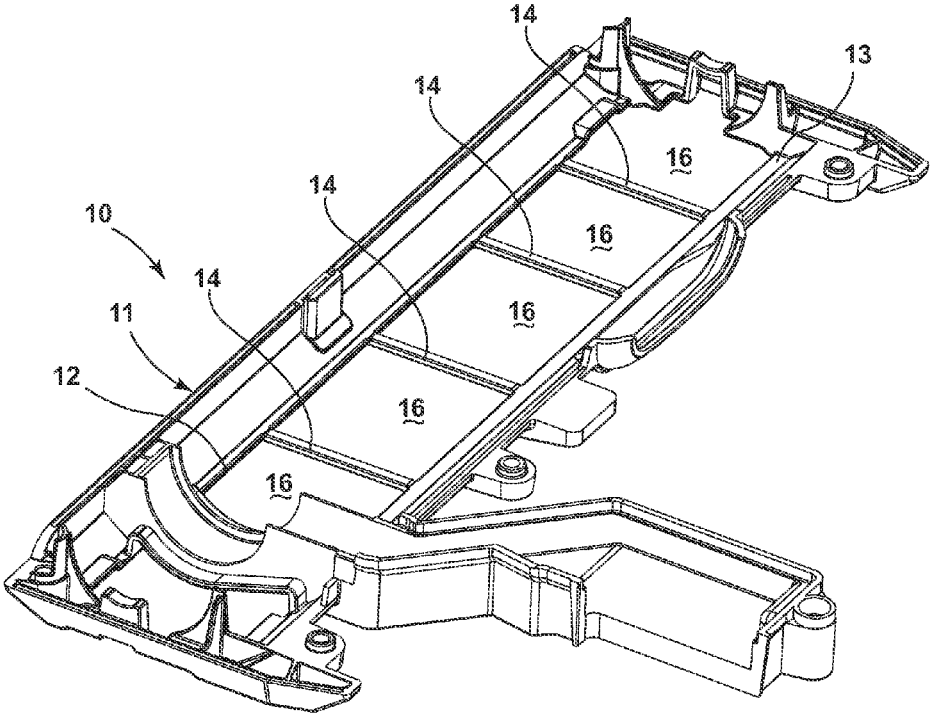
FIG. 1 (PRIOR ART)
FIG. 1 is a perspective view of a prior art sole plate of a vacuum cleaner.
Figure 2:
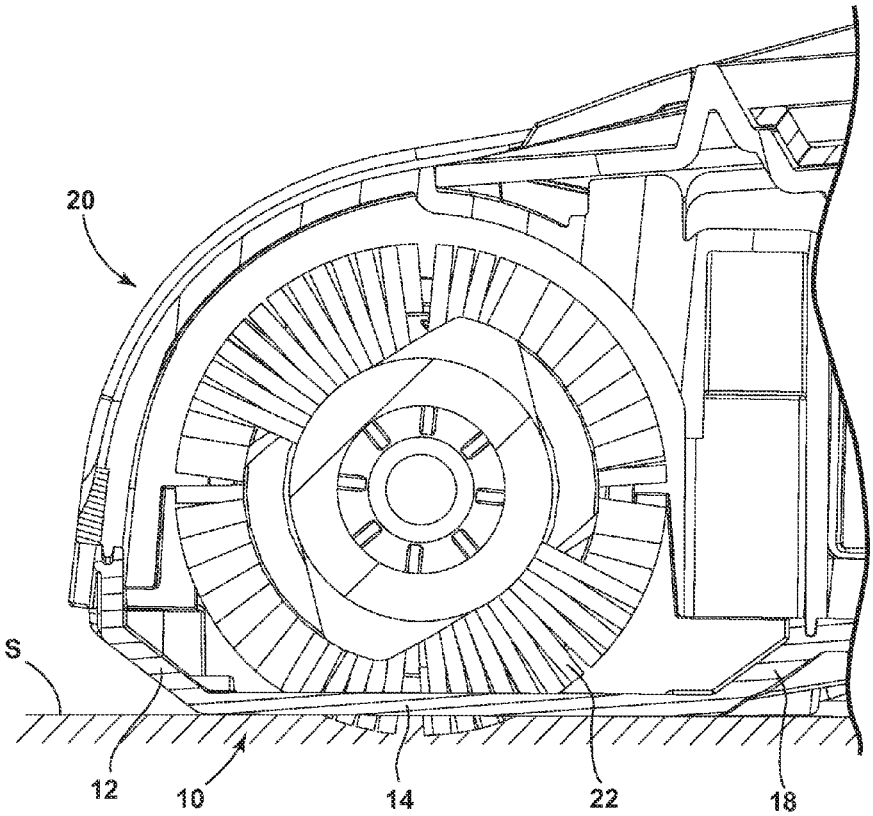
FIG. 2 (PRIOR ART)
FIG. 2 is cross sectional view of a portion of a prior art suction nozzle of a vacuum cleaner including the sole plate from FIG. 1.

Table 1 presents data derived from a debris removal test using a common vacuum cleaner to remove a known weight of debris from different carpet types, including plush carpet, level loop carpet, multi-level carpet, and shag carpet. The test comprised placing a known weight of debris onto a specific area of the different carpet types, vacuuming the specific carpet area at a constant speed, and determining the weight of the debris removed. A geometric mean of the debris removed across all carpet types was then calculated. The vacuum cleaner equipped with the sole plate 10 having the linear cross ribs 14 and without a gap between the bottom of the cross rib 14 and surface to be cleaned, S, as shown in FIGS. 1-2, was determined to have removed a geometric mean of 26.4 grams of debris across all carpet types. The vacuum cleaner equipped with the sole plate 118 having the upwardly curved cross ribs 134 as shown in FIGS. 3-7 was determined to have removed a geometric mean of 28.4 grams of debris across all carpet types. This resulted in an approximately 7.5% improvement of debris removal for the vacuum cleaner equipped with the sole plate 118 having upwardly curved cross ribs 134 over the vacuum cleaner equipped with the sole plate 10 having linear cross ribs 14, even with no appreciable performance improvement on shag carpet.

The largest performance difference was observed on level loop, which showed a relative 12.7% cleaning improvement, whereas the performance on shag carpet was virtually unchanged. The results tend to indicate a proportional relationship between effectiveness of the sole plate 118 with upwardly curved cross ribs 134 on improving cleaning performance and carpet pile height; i.e. increasing improvements in cleaning performance as the carpet pile heights decrease and decreasing improvements in cleaning performance as the carpet pile heights increase. This suggests that the higher pile carpet fibers may tend to encroach or block the gaps 142 thereby impeding debris from passing beneath the upwardly curved cross ribs 134 and through the suction nozzle openings 136.

TABLE 1

| | | Carpet Type | | | | |
|---|---|---|---|---|---|---|
| Product | Sole Plate | Plush Carpet | Level Loop Carpet | Multi-level Carpet | Shag Carpet | Geometric Mean |
| | | Weight of Debris Removed (grams) | | | | |
| Vacuum X | Linear Cross Ribs | 38.5 | 59.0 | 25.7 | 8.3 | 26.4 |
| | Upwardly Curved Cross Ribs | 41.8 | 66.5 | 28.7 | 8.1 | 28.4 |
| Percent Improvement in Cleaning | | 8.6% | 12.7% | 11.7% | −2.4% | 7.5% |

The vacuum cleaner 100 disclosed herein provides improved cleaning performance. One advantage that may be realized in the practice of some embodiments of the described vacuum cleaner 100 is that the vacuum cleaner 100 can be configured to avoid trapping debris between the sole plate 118 upwardly curved cross ribs 134 and surface to be cleaned S, and will instead allow the debris to pass laterally under the upwardly curved cross ribs 134 so that the debris may be drawn into the base unit 104 and the separating and collection unit 108.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner comprising:

a housing having a suction nozzle;

a source of suction in fluid communication with the suction nozzle for generating a working airstream through the suction nozzle;

a separating and collection assembly for separating and collecting debris from the working airstream;

an agitator provided within the suction nozzle; and a sole plate defining a suction inlet for the suction nozzle and provided on a lower side of the suction nozzle, wherein the sole plate comprises a front wall, a rear wall, and a plurality of upwardly-curved cross ribs extending between the front and rear walls;

wherein the cross ribs are curved at a center of the cross ribs between the front and rear walls.

2. The vacuum cleaner of claim 1, wherein the cross ribs define a tunnel forming a debris path, such that debris may pass beneath the cross ribs through the tunnel in a substantially lateral direction along the debris path before being ingested through the suction inlet.

3. The vacuum cleaner of claim 1, wherein the sole plate secures the agitator within the housing.

4. The vacuum cleaner of claim 3, wherein the sole plate comprises agitator mounting locations configured to mount the agitator adjacent the suction inlet.

5. The vacuum cleaner of claim 3, wherein the agitator comprises a rotatable brushroll positioned within the suction nozzle adjacent the suction inlet for rotational movement about an axis.

6. The vacuum cleaner of claim 5, wherein the cross ribs define a tunnel with a debris path axis that is spaced from the axis.

7. The vacuum cleaner of claim 5, wherein the brushroll comprises a dowel with a plurality of bristles projecting from the dowel, and a plurality of grooves formed on the dowel for clearance of the cross-ribs.

8. The vacuum cleaner of claim 1, wherein the cross ribs define a substantially semicircular gap between a surface to be cleaned and a bottom of the cross ribs.

9. The vacuum cleaner of claim 1, wherein multiple suction nozzle openings are defined by spaces between the cross ribs and the front and rear walls to collectively form the suction inlet.

10. The vacuum cleaner of claim 1, wherein the sole plate further comprises a belt guard.

11. The vacuum cleaner of claim 1, wherein the housing comprises an upright unit coupled with a base unit adapted to be moved over a surface to be cleaned, and wherein the suction nozzle, agitator, and sole plate are provided with the base unit.

12. The vacuum cleaner of claim 11, wherein the base unit comprises an upper base housing and the sole plate is fastened to the underside of the upper base housing.

13. The vacuum cleaner of claim 11, wherein the source of suction comprises a motor/fan assembly carried by the upright unit.

14. The vacuum cleaner of claim 1, wherein the collection assembly comprises a cyclone separator separating contaminants from a working airstream and a removable debris cup receiving the separated contaminants from the cyclone separator.

15. The vacuum cleaner of claim 1, wherein no portion of the plurality of cross ribs extends below the front and rear walls.

16. The vacuum cleaner of claim 1, wherein the sole plate comprises a perimeter frame defined by the front and rear walls, and further defined by side walls extending between the front and rear walls, wherein no portion of the plurality of cross ribs extends below the perimeter frame.

17. A vacuum cleaner comprising:

a housing having a suction nozzle;

a source of suction in fluid communication with the suction nozzle for generating a working airstream through the suction nozzle;

a separating and collection assembly for separating and collecting debris from the working airstream;

an agitator provided within the suction nozzle; and a sole plate defining a suction inlet for the suction nozzle and provided on a lower side of the suction nozzle, wherein the sole plate comprises a front wall, a rear wall, and a plurality of cross ribs extending between the front and rear walls;

wherein the cross ribs define a gap between a surface to be cleaned and a bottom of the cross ribs, wherein the gap comprises a substantially semicircular gap between the surface to be cleaned and the bottom of the cross ribs.

18. The vacuum cleaner of claim 17, wherein the cross ribs have an arched shape that spans between the front and rear walls.

* * * * *